United States Patent [19]

Mason

[11] Patent Number: 4,732,431

[45] Date of Patent: Mar. 22, 1988

[54] INTERCHANGEABLE DOOR PANELS FOR DISHWASHER

[75] Inventor: Anthony Mason, Lincoln Township, Berrien County, Mich.

[73] Assignee: Whirlpool Corporation, Benton Harbor, Mich.

[21] Appl. No.: 865,514

[22] Filed: May 21, 1986

[51] Int. Cl.[4] ..... E06B 00/00

[52] U.S. Cl. ..... 312/109; 312/257 A; D32/3

[58] Field of Search ..... 312/257 A, 108, 109, 312/138 R; 52/821, 822, 823; 126/190; 40/490; D32/3

[56] References Cited

U.S. PATENT DOCUMENTS

| | | | |
|---|---|---|---|
| 2,324,710 | 7/1943 | Livar . | |
| 3,228,736 | 1/1966 | Beckerman | 312/108 |
| 3,338,649 | 8/1967 | Stewart | 312/204 |
| 3,866,824 | 2/1975 | Lewis | 40/490 |
| 3,936,107 | 2/1976 | Gourdeau et al. | 312/138 R |
| 4,229,921 | 10/1980 | Schell | 312/257 SM |
| 4,438,993 | 3/1984 | Rabas | 312/257 A |
| 4,448,463 | 5/1984 | Amos | 312/257 A |

FOREIGN PATENT DOCUMENTS

| | | | |
|---|---|---|---|
| 0627258 | 1/1963 | Belgium | 312/108 |
| 2454777 | 12/1980 | France | 312/257 A |
| 1445862 | 8/1976 | United Kingdom . | |

*Primary Examiner*—Kenneth J. Dorner
*Assistant Examiner*—Gerald A. Anderson
*Attorney, Agent, or Firm*—Wood, Dalton, Phillips, Mason & Rowe

[57] ABSTRACT

A door frame is provided comprising a pair of laterally spaced, vertically directed and parallel frame members defining channels opening laterally towards each other. A bottom frame member connects between the two side frame members and defines an upwardly opening channel. A decorative panel sheet is dimensioned so that it must be bowed slightly to present its opposite edges to the channels in the side frame members. Upon releasing the panel, the edges penetrate the channel and are confined against fore and aft shifting. The dimension between a control console on the top of the door and the bottom frame member is greater than the spacing between the upper and lower edges of the panel. This allows the panel to be unbowed without interference from the bottom frame member. With the panel assuming its flattened state the panel can be shifted downwardly into the channel in the bottom frame member. A retaining strip holds the upper edge of the panel against the control console. Preferably, the retaining strip is arranged to be snap fit into place so that it can be readily removed when it is desired to change the exposed face of the door.

16 Claims, 5 Drawing Figures

FIG. 1
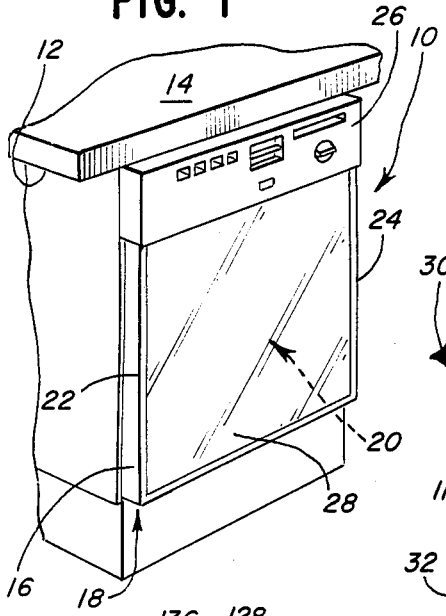
FIG. 3
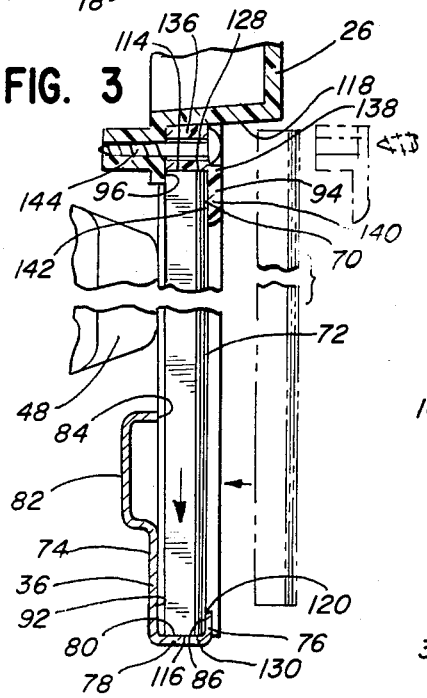
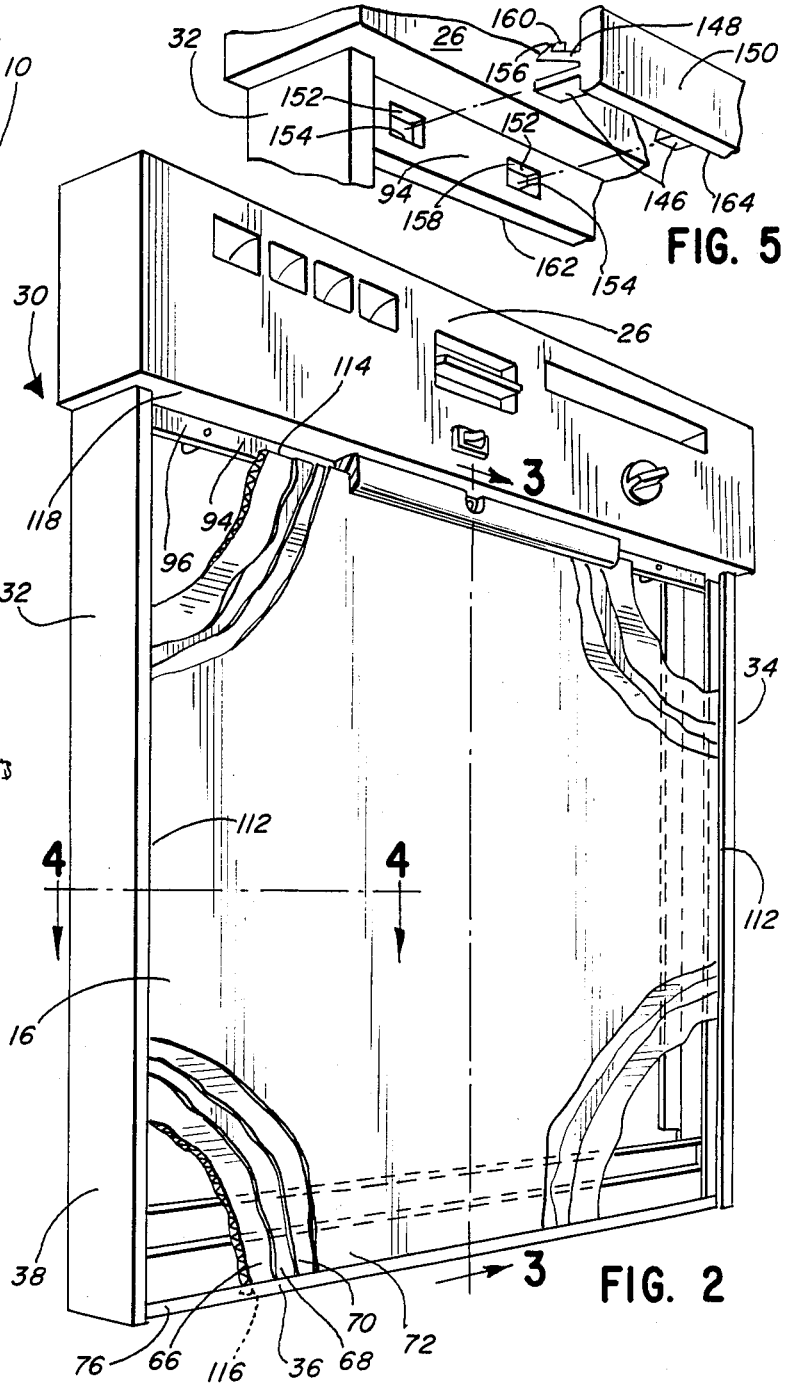
FIG. 5
FIG. 2
FIG. 4
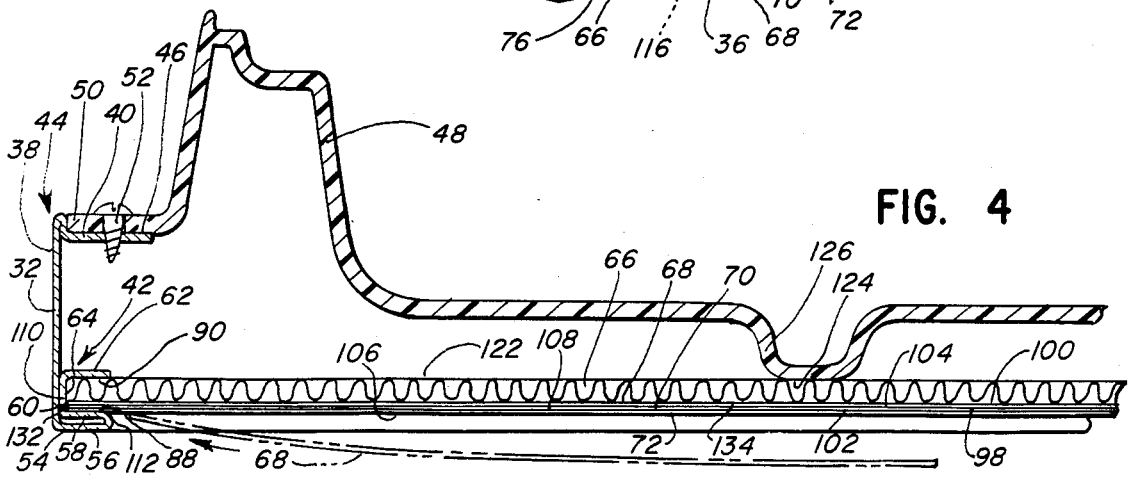

INTERCHANGEABLE DOOR PANELS FOR DISHWASHER

BACKGROUND OF THE INVENTION

1. Field of the Invention

This invention relates to movable doors and, in particular, to doors for use in electrical appliances such as dishwashers.

2. Description of the Prior Art

Electrical appliance doors are known having a decorative front panel with oppositely facing flat surfaces which can be selectively exposed at the front of the door. Alternatively the panel can be replaced and, in the case of multiple panels, the panels can be arranged to selectively expose a desired one of a number of surfaces at the front of the door. This feature is desirable from a manufacturing standpoint as it eliminates the need to manufacture and inventory appliances by color.

Designers of appliances with interchangeable panels have striven to develop a simplified way of mounting the panels for facilitated assembly and interchange of differently colored and/or textured door panels.

An exemplary structure with interchangeable panels is shown in U.S. Pat. No. 3,936,107, to Gourdeau et al. Gourdeau et al disclose hinged structure for pivoting a pack of panels outwardly to facilitate removal, placement and/or interchange of individual panels. Trim strips seal the panel pack in its assembled position.

An alternative door structure with a changeable door panel is described in U.S. Pat. No. 4,229,921, to Schell. In Schell an entire subassembly is attached to the front of the appliance door. One must assemble a support panel 20, an insert 19, a pair of channels 34 and a series of screw grommets 39 to define the subassembly which in turn must be attached as a unit to the inner door 12. Schell contemplates conversion of the unit through interchange of the entire subassembly. The complications associated with the manufacture and assembly of the subassemblies is apparent. Further, the problems associated with controlling colored appliances is contended with with the bulky subassemblies.

A further drawback with conventional structures is that normally the framework, for reasons of aesthetics, is covered with separate trim elements. This adds significantly to manufacturing costs and complicates assembly and disassembly of the door.

SUMMARY OF THE INVENTION

The present invention is specifically directed to overcoming the above enumerated problems in a novel and simple manner.

The invention comprehends the provision of a plurality of flexible, decorative panels which can be simply interchanged and arranged to expose a desired surface finish at the front of an appliance door.

In a preferred form the door frame comprises a pair of laterally spaced, vertically directed and parallel frame members defining side channels opening laterally towards each other. A bottom frame member connects between the two side frame members and defines an upwardly opening channel. The panel is dimensioned so that it must be bowed slightly to present opposite edges to the channels in the side frame members. Upon releasing the panel to a flattened state, the edges penetrate the channels and are thereby confined against fore and aft shifting.

The dimension between a control console on the top of the door and the bottom frame member is greater than the spacing between the upper and lower edges of the panel. This allows the panel to be introduced to the side channels and released to a flattened state without interference between the panel and console or bottom frame member. With the panel in its flattened state it can be shifted downwardly into the channel in the bottom frame member. A retaining strip holds the upper edge of the panel against the control console. Preferably, the retaining strip is arranged to be snap-fit into place so that it can be readily removed when it is desired to change the appearance of the door.

Preferably, three panels are mounted on the door in like fashion. The user then has the option of six decorative faces to be employed selectively at the front of the door. To accommodate the additional panels, a deformable spacer, shaped similarly to the panels, is fit on the door. This spacer affords a cushion to allow placement of the panels and, with the panels in place, exerts a slight forward force on the panels which maintains them in position.

The invention has as its principle objective the provision of a simply constructed door which facilitates interchange of decorative panels. The invention overcomes the obstacle of the control console or other door structure which prohibits the slide fitting of the panels in the receptive channels. By simply removing the retaining strip from the top of the panel, one can easily remove, rearrange and replace the panels in as few as three simple steps without the use of tools or separate fasteners. With the exception of the retaining strip, the only contemplated movement of parts for conversion from one color to the next is the movement of the panels themselves.

Another aspect of the invention is the provision of the frame members on the sides and bottom, which define the receptive channels for the panels, as the exposed edges of the door. With these frame members appropriately finished, the need for decorative trims and the like is obviated. A reduction in the number of parts and the attendant costs of manufacture results.

BRIEF DESCRIPTION OF THE DRAWINGS

Other features and advantages of the invention will be apparent from the following description taken in connection with the accompanying drawings wherein:

FIG. 1 is a perspective view of an under-the-counter dishwasher provided with a door construction embodying the present invention;

FIG. 2 is a perspective view of the door broken away to reveal stacked, interchangeable panels;

FIG. 3 is an enlarged sectional view of the door along line 3—3 of FIG. 2;

FIG. 4 is an enlarged sectional view of the door along line 4—4 of FIG. 2; and FIG. 5 is an enlarged, fragmentary perspective view of an alternative type of retaining strip for the upper edge of the panel to the strip in FIG. 2.

DESCRIPTION OF THE PREFERRED EMBODIMENT

A floor mounted, under-the-counter dishwasher embodying the inventive door structure is shown at 10 in FIG. 1. The dishwasher is dimensioned vertically to reside closely beneath the underside 12 of a kitchen counter 14. The dishwasher door 16 is conventionally hinged at its lower edge 18 for pivoting about a horizontal axis between an open position, wherein access can be gained to an interior washing chamber 20 and a closed position depicted in FIG. 1 wherein the door closes and seals an access opeing at the front of the chamber 20 during operation.

The exposed portion of the dishwasher comprises generally laterally spaced side edges 22, 24, a control console 26 and a forwardly facing door panel surface 28. The control console 26 is generally designed to be neutral in appearance to match commonly used appliance colors. The most predominant part of the dishwasher to the eye is the door panel surface 28. The color of this surface must be coordinated with a kitchen decor and it is the interchangeability of this door panel surface that the present invention is specifically directed to.

The details of the inventive structure can be seen clearly from the drawings in FIGS. 2–5. The door 16 has a fixed frame at 30 comprising spaced, vertically directed, substantially parallel, side frame members 32, 34 and a bottom frame member 36 which interconnects the side frame members 32, 34 adjacent their bottom edge. The control console 26 extends between the side frame members 32, 34 at their upper region so that the side frame members 32, 34, bottom frame member 36 and console 26 cooperatively bound a rectangular space.

Each of the side frame members has the same configuration and is roll formed from a sheet metal blank and thus description of the details of the frame members 32, 34 will be limited to exemplary member 32. The side frame member 32, as illustrated in FIG. 4, has a laterally exposed edge surface 38, a liner support leg 40 and a channel forming portion at 42. The rear side of the frame member is doubled over itself at 44 and projects laterally inwardly to define the leg 40 and a seating surface 46 thereon for a plastic liner 48 conventionally placed on the inside of the dishwasher door. The liner has a peripheral flange 50 which is assembled as by screws 52 to the leg 40.

At its front, the frame member 32 has a leg 54 with a forwardly facing surface 56. From the leg 54 the frame is doubled back on itself to define a forward channel-forming leg 58, turned to define a leg 60 disposed against the side frame member 32 and turned therefrom inwardly to define a rear leg 62. The forward leg 58, leg 60 and rear leg 62 cooperatively bound a U-shaped channel 64. The channels in the side frame members 32, 34 face towards each other and are dimensioned to accept a deformable spacer 66 and preferably up to three separate door panels 68, 70, 72, as more fully described below.

The bottom frame member 36 also is roll formed from a metal blank and is detailed in FIGS. 2 and 3. The bottom frame member 36 comprises a rear leg 74 and forward leg 76, which legs, in cooperation with a base leg 78, bound an upwardly opening, U-shaped channel 80. The rear leg 74 of the bottom frame member 36 extends upwardly and is bent to define a forwardly opening, U-shaped portion 82 with a free edge 84 on one of the legs of the U disposed to bear against the liner 48.

The rearwardly facing surface 86 of the forward leg 76 of the bottom frame member and the rearwardly facing surfaces 88 (FIG. 4) of the forward legs 58 of the side frame members are substantially co-planar. The forwardly facing surfaces 90 of the rear legs 62 of the side frame members and the forwardly facing surface 92 of the rear leg 74 of the bottom frame member are also in substantially co-planar relationship. The control console 26 has an integral depending flange 94 (FIGS. 2 and 3) with a forwardly facing surface 96 substantially in the plane of the surfaces 90, 92 on the frame members 32, 34, 36.

Each of the decorative door panels 68, 70, 72 comprises preferably a rectangular or square sheet of flexible metal with oppositely facing flat surfaces 98, 100; 102, 104; and 106, 108, respectively. Each of the surfaces is preferably painted with a different color and/or has a different surface texture and according to the invention can be readily selectively placed for exposure at the front side of the door.

Before the panels 68, 70, 72 are put in place, the deformable spacer 66 is assembled. The spacer 66 preferably comprises a sheet of treated, corrugated cardboard and is substantially matched to the rectangular or square configuration of the panels. To assemble the spacer, it is first bowed, thereby bringing the vertically extending side edges 110 (one shown in FIG. 4) sufficiently close to each other to clear the forward free edges 112 of the forward leg 58 of the frame members 32, 34 as the spacer is urged towards the frame from the front thereof to simultaneously present the side edge 110 at the channel openings. The spacer cannot be introduced from the front of the frame without bowing as the panel is wider than the spacing between the free edges 112. Slide fitting of the spacer in the channels downwardly from the top of the door is prevented by the forwardly projecting control console 26.

The spacing between the top edge 114 and bottom edge 116 of the spacer 66 is less than the distance between a downwardly facing surface 118 on the control console 26 and the upper free edge 120 on the forward leg 76 of the bottom frame member 36. This allows the spacer 66 to be released to its flattened state without interference between the spacer and the forward leg 76 of the frame member and the control console. With the spacer flattened, the edges 110 thereof enter the U-shaped channels 64 and seat adjacent the legs 60 of the side frame members 32, 34. In this position, the rearwardly facing surface 122 of the spacer abuts a forwardly facing surface 124 on each of a series of vertically extending reinforcing ribs 126 on the liner 48. The spacer 66 is then shifted downwardly to abut the bottom edge 116 thereof to the base leg 78 of the bottom frame member 36.

The panels 68, 70, 72 are assembled in similar fashion to the spacer 66. Using panel 68 for illustration purposes, it will be seen that the panel 68 has parallel upper and lower peripheral, rectilinear edge portions 128, 130, respectively and parallel, vertically extending rectilinear side edge portions 132 (one shown in FIG. 4). The panel 68 is bowed so that the side edges 130 are brought sufficiently close to each other to clear the free edges 112 upon assembly of the panel 68 from the front of the door as shown in phantom in FIG. 4. The edges 132 can then be leaned against the forwardly facing surface 134 of the spacer and are guided thereby into seated position as the panel is released to its flattened state. In its flattened state, the panel 68 closely facially overlies the spacer 66 with the side edges 132 residing in close proximity to the legs 60 of the side frame members 32, 34. In similar fashion to the assembly of the spacer 66, the panel 68 is slid downwardly to seat in the channel 80 associated with the bottom frame member. One or two additional panels can be assembled, however this is optional. The deformable spacer 66 affords a cushion that facilitates placement of the superjacent panels 70, 72.

With the spacer 66 and panels 68, 70, 72 assembled, there are residual forces in the spacer exerting a slight forward pressure on the panels and bearing the forwardly facing surface 106 of the forwardmost panel 72 against the rearwardly facing surfaces 88 on the side frame members and the rearwardly facing surface 86 on the bottom frame member. The panels are thus held firmly in place.

With the spacer 66 and the panels in assembled relationship and the bottom edges thereof located in the bottom channel 80, the upper portion of the rearwardly facing surface of the spacer seats against the forwardly facing surface 96 on the depending flange 94 on the control console 26. A slight space is maintained between the top edges of the spacer and panels and the downwardly facing top edges of the spacer and panels and the downwardly facing surface 118 on the bottom of the control console 26. Within this space, one leg 136 of an L-shaped retainer strip 138 can be placed. The other leg 140 of the strip depends from the leg 136 and overlies the forwardmost panel 72. With the leg 136 abutted against the surface 96 on the console 26, the rearwardly facing surface 142 of the leg 140 maintains the spacer 66 and panel 68, 70, 72 in close captive relationship.

Two exemplary strucures for assembling the strip 138 are shown. In one structure shown in FIGS. 2 and 3, screws 144 are used. Alternatively, a snap fit connection is shown in FIG. 5. In the FIG. 5 construction, a guide leg 146 and deflectable ramped leg 148 are provided in pairs along the strip body 150 and project rearwardly therefrom. A plurality of rectangular apertures 152 are provided in the depending flange 94 on the console 26. The guide leg 146 is abutted with the bottom surface 154 of each aperture 152. As the strip is moved rearwardly, a ramp surface 156 encounters the upper edge 158 of the aperture 152 and causes the leg 148 to deflect downwardly. In a fully seated position, the deflectable leg 148 springs back up and seats a shoulder 160 thereon behind the rear wall 162 of the flange 94. The flange 94 is thereby held captive between the rearwardly facing surface 164 on the strip body 150 and the shoulder 160. By bending the leg 148 downwardly from the rear of the flange 94, the strip can be released.

With the inventive structure the user can simply choose a desired surface panel color. By first removing the strip 138 the panels can be successively bowed and removed and placed back in an order that will expose the desired panel surface.

Another aspect of the invention involves having the frame members 32, 34, 36 exposed as the finished edges of the door. This eliminates the need for any decorative strips and thereby simplifies construction of the door.

The foregoing disclosure of specific embodiments is illustrative of the broadened concepts comprehended by the invention.

What is claimed is:

1. A door for use with an electrically operated appliance, said door comprising:

a frame having a front side, and defining first and second spaced, panel-receiving channels opening towards each other, and a third channel, said first and second channels each having a first end adjacent to the third channel and a second end remote from the third channel, said first, second and third channels cooperatively defining a U-shaped channel, said frame further having a fixed wall with a surface adjacent to the second ends of said first and second channels and facing said third channel;

a first, flexible, decorative panel, said panel being substantially flat and defining a first decorative surface to be exposed at the front of the door, said panel having peripheral, rectilinear edge portions, a first and a second of said edge portions being noncontiguous to each other and spaced sufficiently that the panel must be bowed to bring said first and second edge portions towards each other to permit entry of the first and second edge portions into said first and second channels of the frame while the panel is urged toward said front side of the frame and permit the first and second edge portions of the panel when aligned with said first and second channels to be released to permit the panel to return to a flattened state so that said first and second edge portions are retained in said first and second channels, said panel further defining third and fourth edge portions, said fixed wall preventing assembly of the panel onto the frame by introduction of the first and second panel edges adjacent said third panel edge into the first and second channels at the second end of the first and second channels, said third channel being arranged so that the panel must be moved parallel to the plane of the flat decorative surface to seat the third panel edge portion in the third channel; and means for removably retaining the fourth panel edge portion in association with the frame, whereby the panel is removably mounted to said frame by installation from the front side of the frame, and said retaining means is releasable to permit said panel to be separated from the frame as desired.

2. The door according to claim 1 wherein the first and second edge portions are substantially parallel to each other.

3. The door according to claim 1 wherein the retaining means comprises a strip and means are provided for snap-fitting the strip to the frame so that the panel is held captive between the frame and strip.

4. The door according to claim 1 wherein the first decorative panel has a second flat decorative surface parallel to and facing in a direction opposite to the first decorative surface, a second panel is provided having third and fourth oppositely facing flat decorative surfaces and the first and second panels can be mounted interchangeably in facially overlapping relationship in the frame to selectively expose any of the first, second, third and fourth surfaces at the front of the door.

5. A door for use with an electrically operated appliance, said door comprising:

a frame having a front side, and defining first and second spaced, panel-receiving channels opening towards each other, and a third channel;

a first, flexible, decorative panel, said panel being substantially flat and defining a first decorative surface to be exposed at the front of the door, said panel having peripheral, rectilinear edge portions, a first and a second of said edge portions being noncontiguous to each other and spaced sufficiently that the panel must be bowed to bring said first and second edge portions toward each other to permit entry of the first and second edge portions into said first and second channels of the frame while the panel is urged toward said front side of the frame and permit the first and second edge portions of the panel when aligned with said first and second channels to be released to permit the panel to return to a flattened state so that said first and second edge portions are retained in said first and second channels, said panel further defining third and fourth edge portions, said third channel being arranged so that the panel must be moved parallel to the plane of the flat decorative surface to seat the third panel edge portion in the third channel;

means for removably retaining the fourth panel edge portion in association with the frame, whereby the panel is removably mounted to said frame by installation from the front side of the frame, and said retaining means is releasable to permit said panel to be separated from the frame as desired; and a liner is attached to the frame and affords a backing for the panel, said frame defines a surface facing rearwardly into each of the first, second and third channels and a deformable spacer is interposed between the liner and panel, said spacer being deformable upon assembly of the panel with the frame and upon the panel being assembled exerting a forward force on the panel to keep the panel in place against the surfaces facing rearwardly into the first, second and third channels.

6. The door according to claim 4 wherein the surfaces facing rearwardly into each of the first, second and third channels are substantially co-planar, there is a control console adjacent the top of the door, and said control console projects forwardly beyond the plane of the surfaces facing into the first, second and third channels and thereby precludes assembly of the panel by movement of the panel downwardly into the first, second and third channels from the top of the door.

7. A door for use with an electrically operated appliance, said door comprising:

a frame assembly consisting of a control console having a downwardly facing surface and a forwardly facing surface adjacent the bottom of the control console, first and second laterally spaced, substantially parallel, vertically extending frame members defining first and second U-shaped channels opening laterally towards each other and a bottom, third frame member defining an upwardly opening, third U-shaped channel, each said first, second and third frame members having a forward leg defining a rewardly facing surface and a rear leg defining a forwardly facing surface, said forward legs on the first and second frame members having substantially parallel free edges;

a first, flexible, decorative panel having oppositely facing decorative first and second surfaces for selective exposure at the front of the door, said first panel being substantially flat and having rectilinear, peripheral edge portions with a first and second of the edge portions in substantially parallel, spaced relationship, said free edges on the first and second frame members being spaced from each other by a distance less than the spacing between the first and second edge portions on the panel so that the panel must be bowed to bring the first and second edge portions on the panel sufficiently close to each other to permit alignment of the first and second edge portions on the panel for entry into the first and second channels upon the panel being released to a flattened state, said downwardly facing surface on the control console and the forward leg of the bottom frame member being spaced so that the first and second edge portions on the first panel can be placed in the first and second channels without interference between the panel and either of the forward leg on the bottom frame member and the control console;

whereupon with the panel released to its flattened state a third edge portion of the panel can be seated in the channel in the bottom frame member by moving the panel vertically downward so that the first, second and third panel edge portions are confined between the forward and rear legs of the first, second and third channels respectively; and means for removably retaining a fourth edge portion of the panel in association with the control console, whereby the panel is removably mounted to said frame by installation from the front side of the frame and said retaining means is releasable to permit said panel to be separated from the frame as desired.

8. The door according to claim 7 wherein the third and fourth edge portions of the panel are substantially parallel to each other, the forward leg on the bottom frame member and downwardly facing surface on the console are substantially parallel to each other and the distance between the third and fourth panel edge portions is less than the distance between the forward leg on the bottom frame member and downwardly facing surface on the console.

9. The door according to claim 7 wherein the retaining means comprises a strip and means are provided for snap-fitting the strip to the control console so that the panel is held removably captive between the strip and the forwardly facing surface of the control console.

10. The door according to claim 7 wherein the first and second frame members are exposed on the door with the door in an assembled state, thereby obviating the need for separate, decorative structure to be placed over the first and second frame members.

11. The door according to claim 7 wherein a liner is mounted to at least one of the console and first, second and third frame members and a deformable spacer is interposed between the liner and panel, said spacer deformable as the panel is assembled and exerting a forward force on the panel to keep the panel in place against the rearwardly facing surfaces on the first, second and third frame members.

12. The door according to claim 7 wherein a deformable spacer is provided against which the first panel abuts with the panel assembled, a second panel similar to the first panel and having oppositely facing decorative third and fourth surfaces is provided and said first and second panels can be assembled in facially overlapping relationship with each other between the spacer and the rearwardly facing surfaces on the first, second and third frame members so that any of the first, second, third and fourth decorative panel surfaces can be exposed at the front of the door.

13. The door according to claim 12 wherein the spacer comprises a corrugated cardboard sheet.

14. The door according to claim 7 wherein the rearwardly facing surfaces on the forward legs of the first, second and third frame members are substantially coplanar and the control console projects forwardly beyond the plane of the rearwardly facing surfaces on the forward legs of the first, second and third frame members and thereby precludes assembly of the panel by movement of the panel downwardly into the first, second and third channels from the top of the door.

15. In an appliance door of the type having a frame assembly with a front side and a flexible panel with a flat surface to be exposed at the front of the frame, improved structure for removably mounting the panel on the frame, the improvement comprising:

said frame having first and second spaced frame members defining first and second panel-receiving longitudinal channels opening towards each other, said first and second frame members each having a forward leg defining a surface facing rearwardly into the first and second channels, said frame having a third frame member defining a third longitudinal panel-receiving channel extending transversely to the first and second channels, said third frame member having a forward leg defining a surface facing rearwardly into the third panel-receiving channel;

said panel having first, second, third and fourth rectilinear, peripheral edge portions for reception in the first, second, and third channels respectively;

said frame assembly having a portion projecting forwardly beyond the channels in the first and second frame members and thereby preventing assembly of the panel into the channels by movement of the panel between the first and second frame members towards the channel in the third frame member, said first and second peripheral edge portions being spaced from each other so that the panel must be bowed to bring the first and second edge portions towards each other sufficiently to permit entry of the first and second edge portions into the first and second channel while the panel is urged toward said front side of the frame and permit the first and second edge portions, when aligned with the first and second channels to be released to permit the panel to return to a flattened state so that said first and second edge portions are retained in said first and second channels, said third and fourth edge portions being spaced so as not to interfere with the forwardly projecting portion of the frame assembly and third frame member upon the introduction of the first and second edge portions into the first and second channel, said third edge portion being seated in the third channel upon the panel being shifted parallel to the plane of the flat surface of the panel with the panel released to its flattened state, whereby the panel is removably mounted to the frame by installation from the front side of the frame.

16. The improved appliance door according to claim 15 wherein means removably retain the fourth panel edge portion in association with the frame.

* * * * *